US006508023B2

(12) United States Patent
Moss et al.

(10) Patent No.: US 6,508,023 B2
(45) Date of Patent: Jan. 21, 2003

(54) MANUALLY OPERABLE AND SELF ERECTING FOLDABLE PLANAR IMAGE BOARD AND EASEL COMPOSITE DISPLAY DEVICE

(76) Inventors: Geoffrey Alan Moss, 56 Genoa Road, Maple, Ontario (CA), L6A 2Y4; David Brian Minister, 1 Red Cedarway, North York (CA), M1B 1A1

( * ) Notice: Subject to any disclaimer, the term of this patent is extended or adjusted under 35 U.S.C. 154(b) by 158 days.

(21) Appl. No.: 09/777,222

(22) Filed: Feb. 6, 2001

(65) Prior Publication Data

US 2002/0104244 A1 Aug. 8, 2002

(51) Int. Cl.[7] ..... G09F 15/00
(52) U.S. Cl. ..... 40/610; 40/787
(58) Field of Search ..... 248/174, 459; 40/610, 750, 754, 755, 787, 539

(56) References Cited

U.S. PATENT DOCUMENTS 631,520 A * 8/1899 Dalsheimer
1,710,814 A * 4/1929 Dyment
2,474,659 A * 6/1949 Ebert
3,727,874 A * 4/1973 Wuensch
5,467,547 A * 11/1995 Fortner ..... 40/610

* cited by examiner

*Primary Examiner*—Joanne Silbermann
(74) *Attorney, Agent, or Firm*—David W. Wong

(57) ABSTRACT

An easel is attachable to the rear surface of an image board to form a composite device. The easel maintains the latter in an upstanding position when erected. It is made of a single board material having a designed pattern stamped therein and having all the components which may be unfolded to form the easel. The erected easel has two mutually parallel vertical side panels and a plurality of horizontal transverse brace members which may be manually unfolded to support the easel in the erected position or tie members may be provided to retained the side panels and the transverse brace members in the unfolded position. The easel and the image board may be folded along a plurality of transverse lines to a compact package for ease in shipping and storage. The image board and the easel are self-erecting when elastic tie members are provided.

12 Claims, 6 Drawing Sheets

MANUALLY OPERABLE AND SELF ERECTING FOLDABLE PLANAR IMAGE BOARD AND EASEL COMPOSITE DISPLAY DEVICE

FIELD OF THE INVENTION

This invention relates to an easel adaptable to the rear surface of a relatively large display image board to support the latter in an upstanding position on a floor. The display image board and the easel are foldable at a plurality of scored transverse fold lines to form a compact and relatively small package for ease in shipping and storage. It may also be self-erecting.

BACKGROUND OF THE INVENTION

Large image display planar boards are used for exhibiting advertisement signs, or for exhibiting life images of movie actors, fashion models, popular musicians, scientific or similar novelty objects for decorative purposes. The large image planar board may be over five feet by two feet in size, and they are commonly made of corrugated board material. In order to support such large image planar board in an upstanding position on a floor, an easel is adapted to its rear surface to form an integral composite device. The easel is commonly also made of corrugated board material which has component parts for forming a rigid support stand. The composite device may be double folded into a collapsed condition for shipping or storage. However, a common drawback in such device is that after it has been double folded into the collapsed condition, it still has a relatively large size. For a life size planar display, the composite device, in the collapsed condition may be over two feet by two feet by two inches in size which would be regarded as an oversize by postal and shipping services, and it is particularly not conducive for shipping through the postal service due to the high postal surcharge imposed on an "oversize" package. The main difficulty with such known display devices is that thick corrugated board material must also be used for making the easel in order to provide the necessary strength for supporting the image board in the upstanding position. Furthermore, the dimensions of the easel must be compatibly large in order to provide the requisite support for the large image corrugated board. Commonly, the easel has one or more vertical support panels having a vertically tapering shape, narrow at the top and tapering to a large bottom base portion. Folding such thick material in more than a double folded manner to a collapsed condition would inherently destroy its strength such that it would lose the necessary strength when it is later unfolded to the erected position from the collapsed condition.

SUMMARY OF THE INVENTION

It is a principal object of the present invention to provide a combined planar large image board and easel device which is foldable in a plurality of transverse lines to a compact size.

It is another object of the present invention to provide an easel which does not lose its strength after subjected to multiple folds along predetermined transverse scored lines.

It is another object of the present invention to provide an image and easel composite device in which the easel may be fabricated with any planar board material and yet would provide a strong support for the display image board in a secure upright erected position.

It is yet another object of the present invention to provide a combined easel and image board composite device which is self-erecting.

The composite device of the present invention has an easel attached to rear surface of an image board and operative to support the latter in an upstanding manner on a floor, the easel comprises a planar board having a design pattern of the easel stamped therein. The design pattern has component parts which are unfoldable to form the easel in an erected condition. The component parts include two elongated substantially rectangular side panels extending the entire longitudinal length of the planar board. A middle body portion extends between the side panels. The middle body portion is attached to the rear surface of the image board. Two parallel vertical scored lines are located between the middle body portion and the side panels such that these side panels are unfoldable along these vertical scored lines to form the right side panel and the left side panel of the easel positioned substantially perpendicular to the image board. A plurality of horizontal brace members are formed in the middle body portion and are located between the side panels. Each brace member is unfoldable along a transverse scored line to a substantially horizontal position extending between the side panels. The brace members are cooperative with the side panels to maintain the easel in an erected condition. A plurality of transverse fold lines are formed in the planar board and are located between the brace members whereby the composite device is foldable at these transverse fold lines to a compact collapsed condition.

DETAIL DESCRIPTION OF THE PREFERRED EMBODIMENTS

Figure 1:
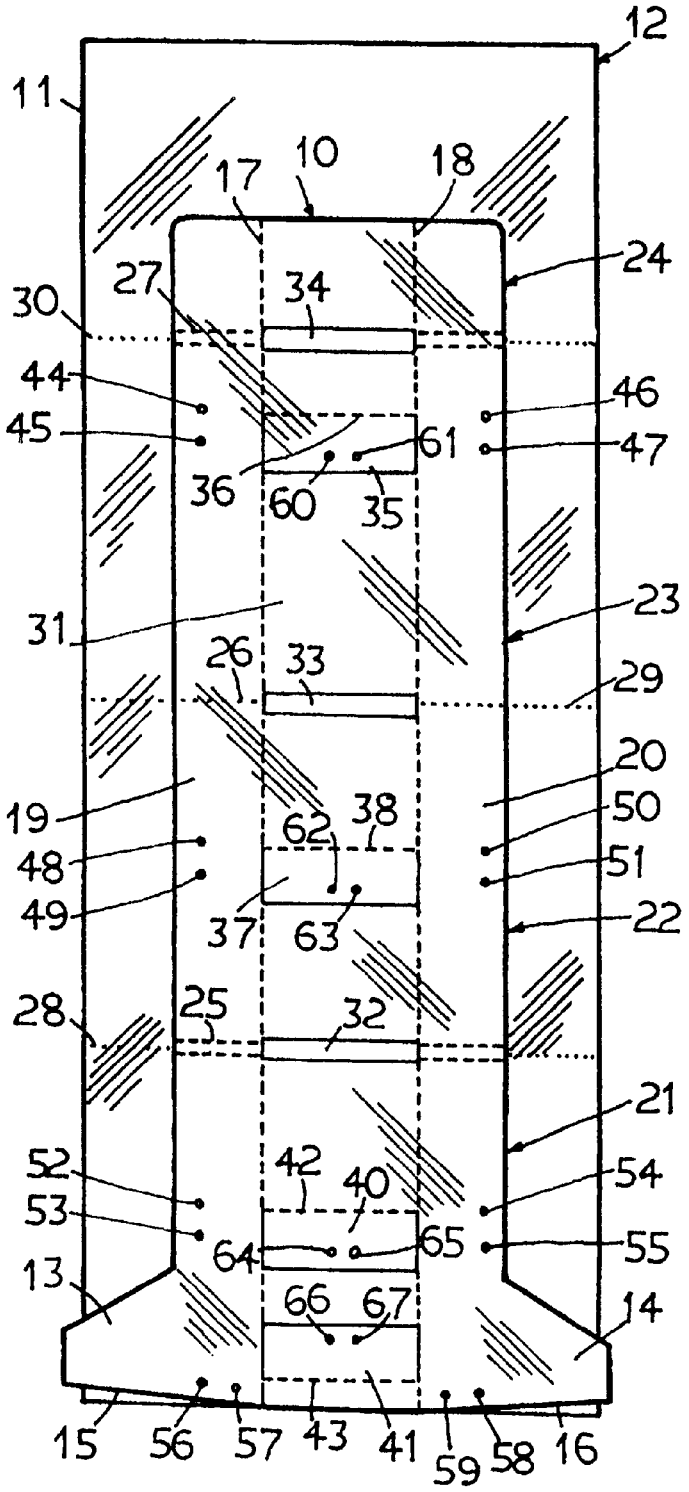
FIG. 1 is a rear elevation view of the easel design stamped on a planar cardboard material. The easel is attached to the rear surface of an image board.
Figure 2:
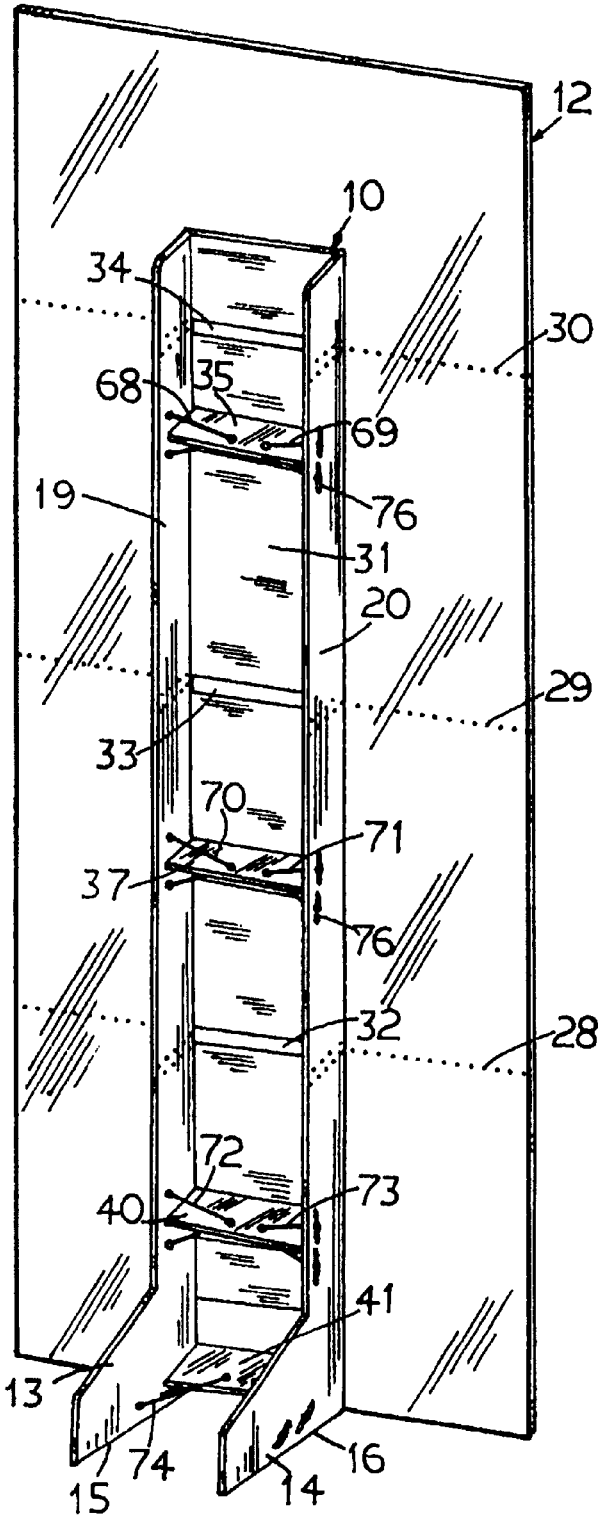
FIG. 2 is a rear perspective elevation view of the composite easel and image board in the erected position.
Figure 3:
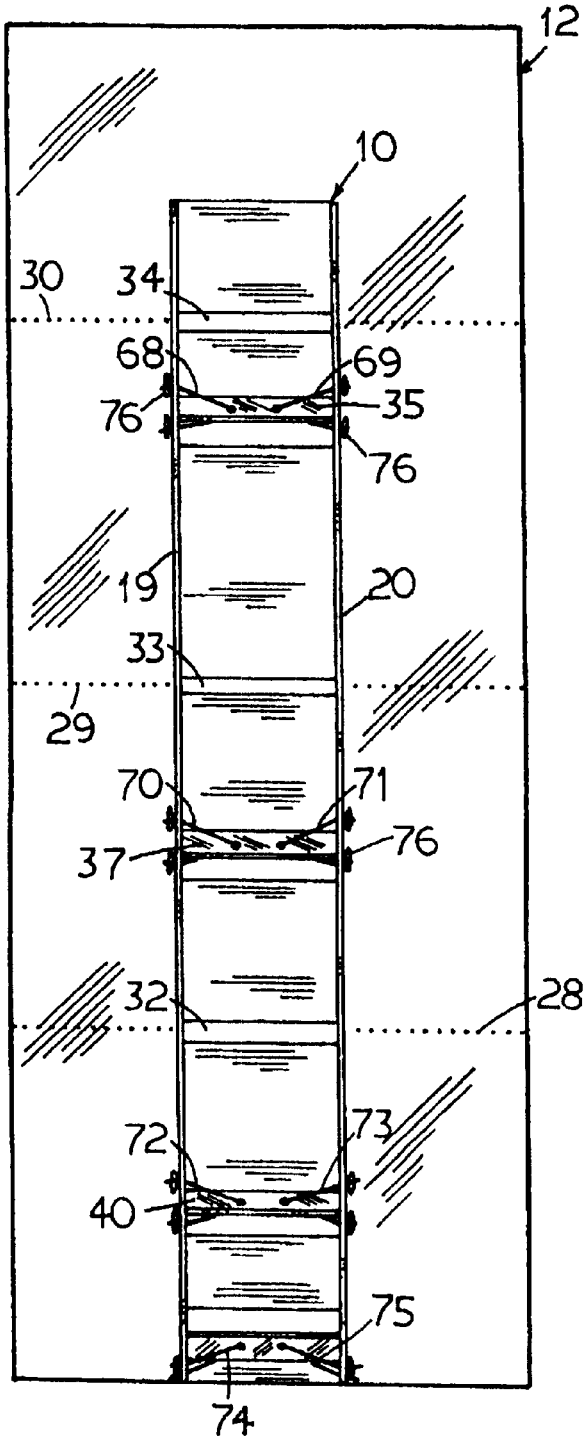
FIG. 3 is a rear elevation view of FIG. 2.
Figure 4:
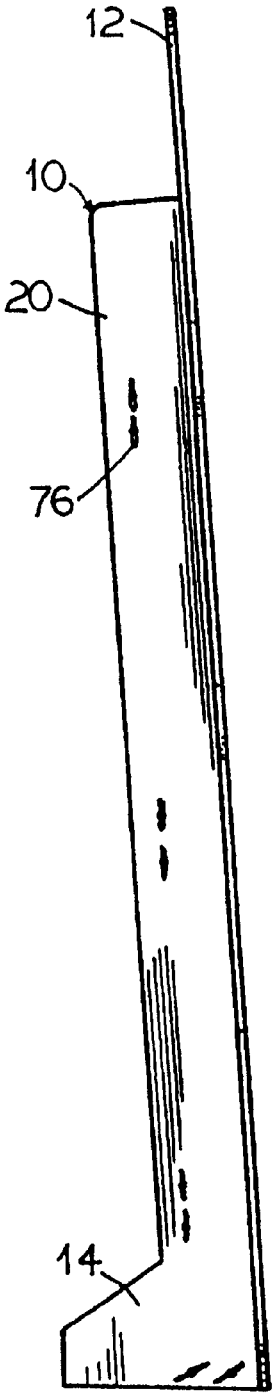
FIG. 4 is a side elevation view of that of FIG. 3.

With reference to the drawings wherein like reference numerals designate corresponding parts in the several views, the easel 10 of the present invention is formed by a designed pattern stamped in an easel board made of cardboard, corrugated board or similar planar board material. The easel 10 is attached to the rear surface 11 of a planar display image board 12. The image board 12 is commonly a large corrugated board having a life size image provided on its front surface. The image board 12 may also have the actual shape of the image. A rectangular board is shown for ease of illustration. The easel design has a generally rectangular shape with two truncated triangular side extensions 13 and 14 formed at its lower portion. The bottom edges 15 and 16 of the side extensions 13 and 14 respectively preferably slope slightly upwardly and outwardly for about 5 degrees relative to the horizontal plane as best shown in FIG. 1. A vertical rectangular pattern is formed at the center of the easel design. The pattern is formed by two mutually parallel vertical scored lines 17 and 18 extending throughout its entire longitudinal vertical length, thus forming two generally L-shaped side panels 19 and 20 with the side extensions 13 and 14 respectively located at their lower portion.

The side panels 19 and 20 are not affixed to the rear surface 11 of the image board 10, and they may be folded or flipped outwards relative to the rear surface 11 of the image board 12 at the vertical scored lines 17 and 18 respectively to a position substantially perpendicular to the rear surface of the image board to provide the required vertical supporting side panels of the easel. The easel 10 is divided into three equal length portions, namely a lower portion 21, a lower middle portion 22, an upper middle portion 23 , and an equal or smaller upper portion 24. The upper portion 24 is smaller because the image to be supported by this portion of the easel normally has a smaller size than the main middle portion of the image. A horizontal scored fold line 25 separates the lower portion 21 and the lower middle portion 22; a second horizontal scored fold line 26 separates the lower middle portion 22 and the upper middle portion 23; and a third horizontal scored fold line 27 separates the upper middle portion 23 and the upper portion 24. The horizontal scored fold lines 25, 26, and 27 are aligned with horizontal scored associated fold lines 28, 29 and 30 respectively formed in the image board 12 such that the composite display device comprising both the easel 10 and the image board 12 together may be folded into a collapsed condition along these horizontal scored fold lines and associated fold lines. Double scored fold lines 25 and 27 may be provided to enhance the foldability of the easel.

The rectangular center body portion 31 of the easel 10 is attached to the rear surface of the image board by glue or other conventional means. A horizontal slot 32 extending over the entire width of the center portion 31 is formed along the scored fold line 25; a second horizontal slot 33 extending over the entire width of the center portion 31 is formed along the scored fold line 26; and a third horizontal slot 34 extending over the entire width of the center portion 31 is formed along the scored fold line 27. The horizontal slots 32, 33, and 34 enhance the foldability of the easel along the horizontal scored fold lines due to the reduction of material to be bent.

A generally rectangular shaped horizontal cross brace 35 is formed in the upper middle portion 23 of the center body portion 31. The cross brace 35 has a horizontal scored line 36 such that it can be flipped outwards relative to the center portion 31 at the scored line 36 to form a brace extending in a horizontal position between the vertical side panels 19 and 20 and perpendicular to the rear surface of the image board. A second similar generally rectangular horizontal cross brace 37 is formed in the lower middle portion 22. The cross brace 37 has a horizontal scored line 38 such that it can be flipped outwards relative to the center body portion 31 at the scored line 38 to form a second brace extending in a horizontal position between the vertical side panels 19 and 20 and perpendicular to the rear surface of the image board. Two similar rectangular cross braces 40 and 41are formed in the lower portion of the center body portion 31. The cross braces 40 and 41 have horizontal scored lines 42 and 43 such that they can be flipped outwards relative to the center body portion 31 to form cross braces extending in a horizontal position between the vertical side panels 19 and 20 and perpendicular to the rear surface of the image board. It can be appreciated by those skilled in the art that although two cross braces are preferably formed in the lower portion 21 to provide a strong base support for the easel, one cross brace may suffice for the purpose.

Two openings 44 and 45 are formed in the vertical side panel 19 and located one above and the other below the horizontal scored line 36 of the cross brace 35. Similarly two openings 46 and 47 are formed in the vertical side panel 20 and located one above and the other below the horizontal scored line 36. Similarly, two openings 48 and 49 are formed in the vertical side panel 19 and located one above and the other below the horizontal scored line 38 of the cross brace 37; and two openings 50 and 51 are formed in the vertical side panel 20 and located one above and the other below the horizontal scored line 38. Two openings 52 and 53 are formed in the vertical side panel 19 and located one above and the other below the horizontal scored line 42 of the cross brace 40; and also similarly two openings 54 and 55 are formed in the vertical side panel 20 and located one above and the other below the horizontal scored line 42. Two openings 56 and 57 are formed in the horizontal manner adjacent to the lower edge of the vertical side panel 19; and similarly two openings 58 and 59 are formed in the horizontal manner adjacent to the lower edge of the vertical side panel 20.

Two openings 60 and 61 are formed adjacent to the free edge of the cross brace 35. Similarly two openings 62 and 63 are formed adjacent to the free edge of the cross brace 37; two openings 64 and 65 are formed adjacent to the free edge of the cross brace 40; and two openings 66 and 67 are formed adjacent to the free edge of the cross brace 41. The easel 10 may be erected by first unfolding the vertical side panels 19 and 20 at the vertical scored lines 17 and 18 until they are positioned generally perpendicular to the rear surface 11 of the image board 12. The cross braces 35, 37, 40 and 41 are then flipped outwards to a horizontal position extending between the vertical panels 19 and 20. Elongated tie members 68, 69, 70, 71, 72, 73, 74 and 75 are then threaded through the openings 44 through 67 to retain the cross braces in the unfolded horizontal position to maintain the easel in the erected condition. The tie members are strings of a predetermined length with a cross abutment bar 76 provided at their two ends such that they may be easily threaded through the various openings in the vertical panels 19 and 20 and the cross braces 35, 37, 40 and 41. After threaded through the openings, the cross abutment bars 76 will position crosswise abutting the openings of the vertical side panels 19 and 20 to retain the easel in the erected condition. The composite easel and image board display device may be folded into a collapse condition by removing the tie members, returning the side panels and cross braces to the flat fold down condition and folding the four portions of the composite display device along the horizontal scored lines.

Figure 5:
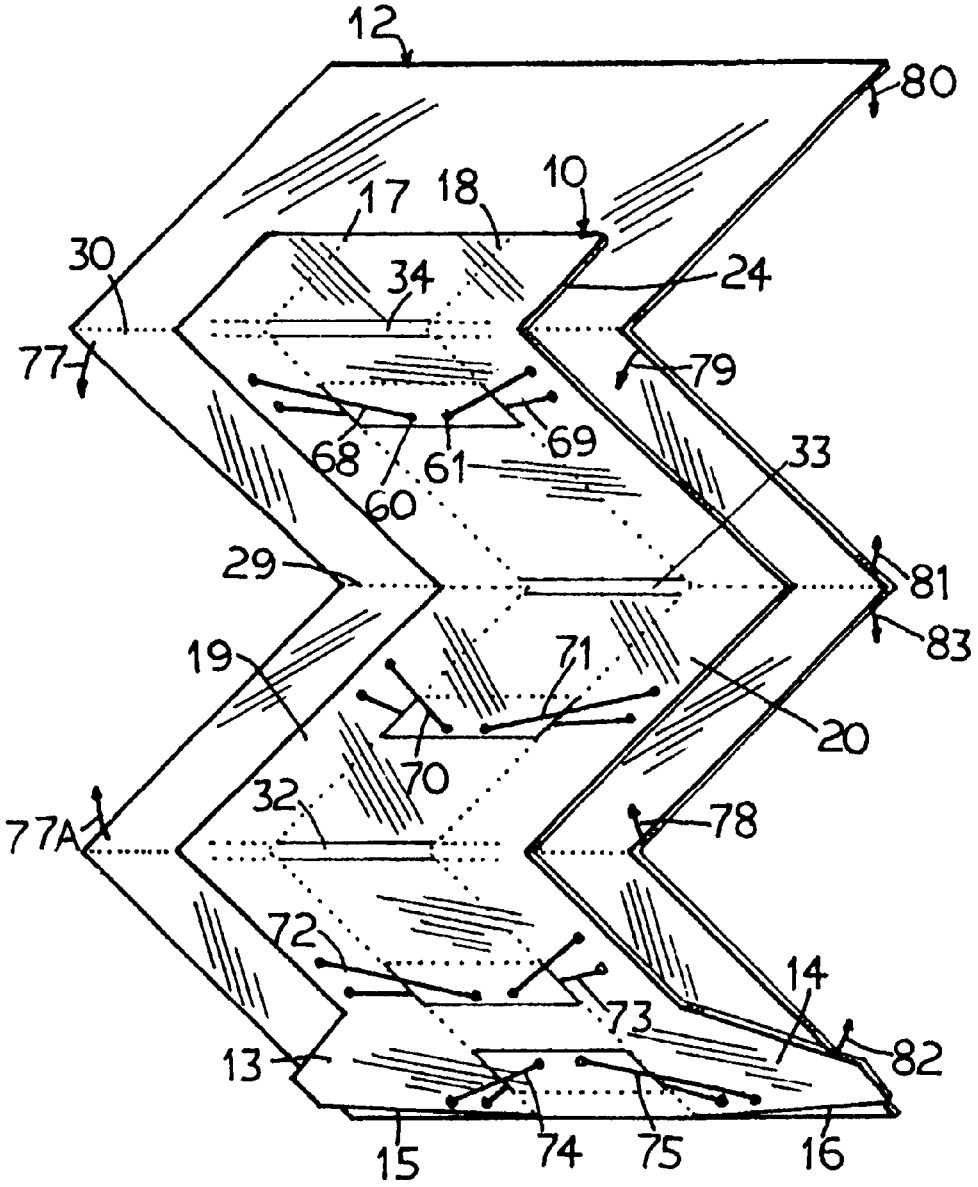
FIG. 5 is a rear perspective view of the composite easel and image board in a partially folded condition.
Figure 6:
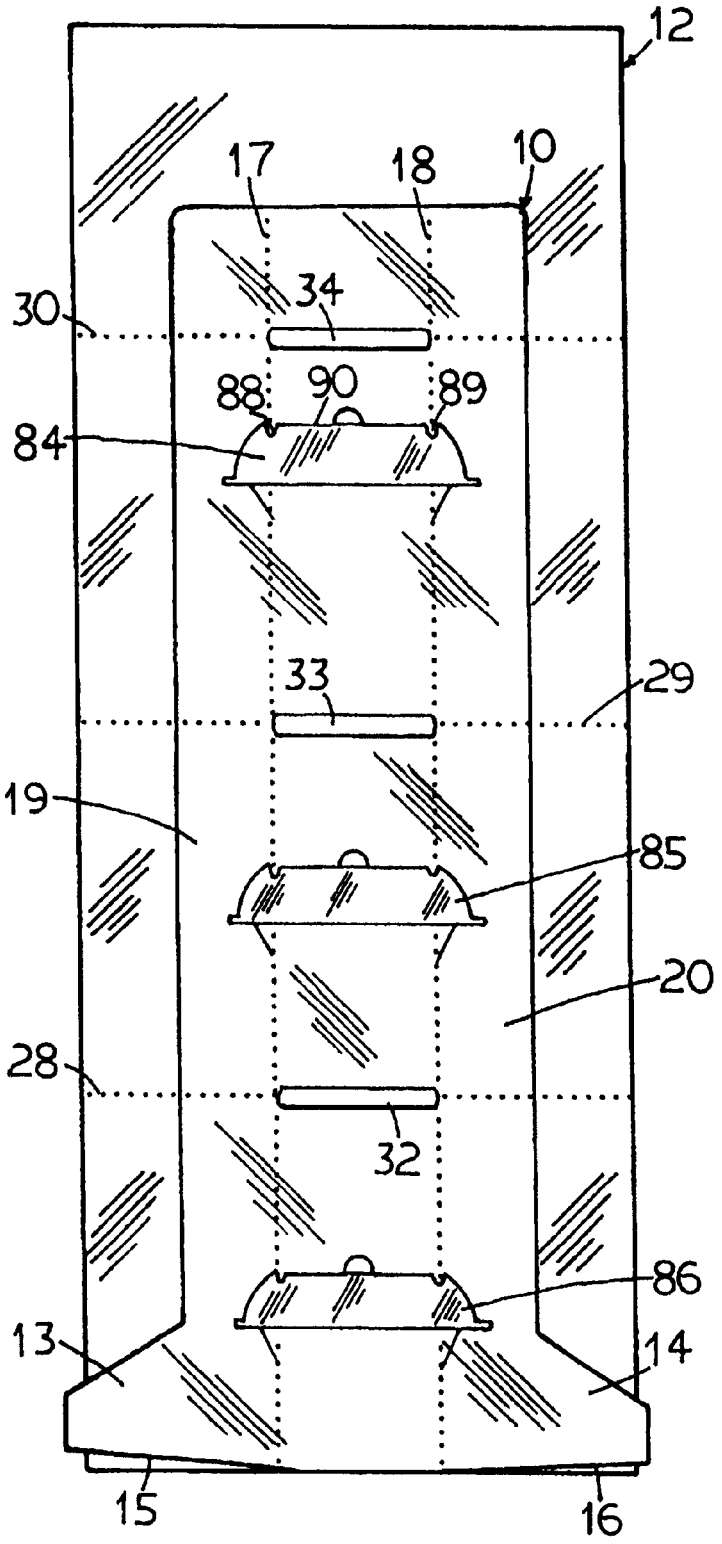
FIG. 6 is a rear elevation view of a alternative embodiment of the composite easel and image board adapted for manual erection.
Figure 8:
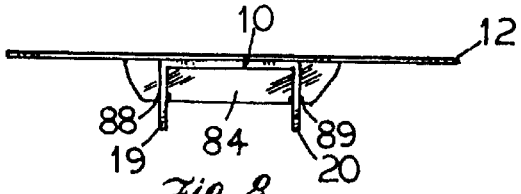
FIG. 8 is a top sectional view along line VIII—VIII of FIG. 7.
Figure 7:
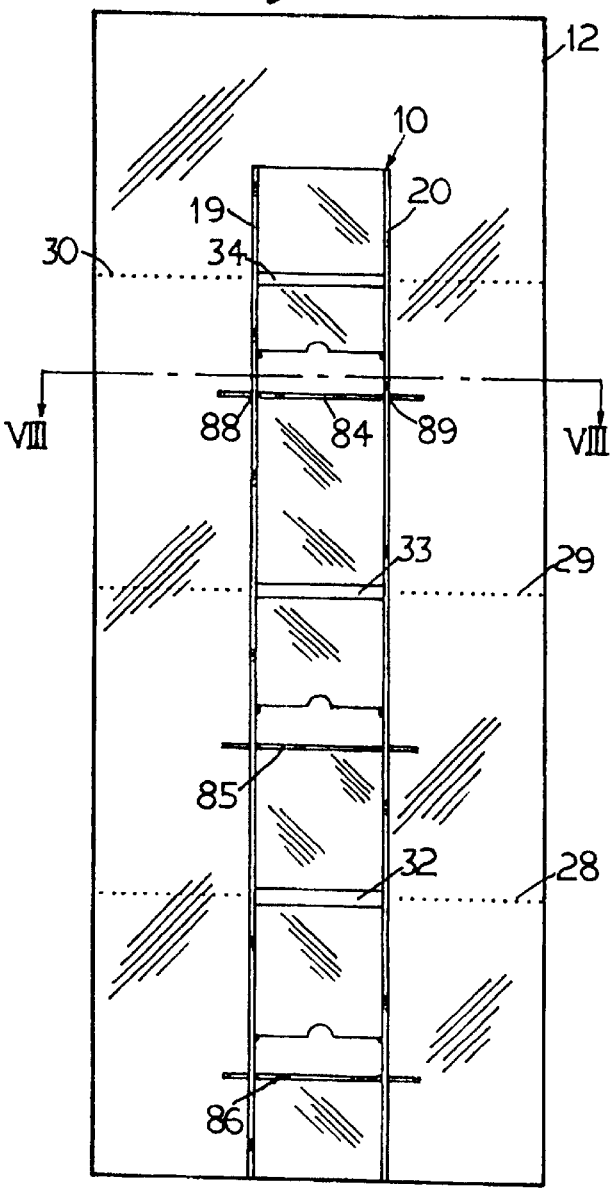
FIG. 7 is a rear elevation of the embodiment shown in FIG. 6, in the erected condition.
Figure 9:
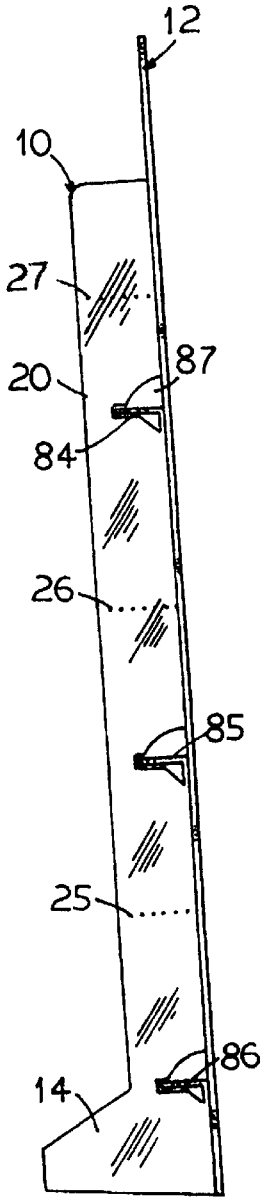
FIG. 9 is a side elevation of that of FIG. 8.

Elastic tie members may be provided such that the resilient force of the elasticity of the tie members would normally maintain the cross braces and the vertical panels in a securely erected condition. The composite easel and image board display device would lean rearward at the top due to the sloping lower edges 15 and 16 of the vertical panels resting on the floor to provide a more stable upstanding manner. The composite easel and image board display device may be folded to the collapse condition without removing the elastic tie members. This may be achieved by first depressing the middle portion of side panels 19 and 20 in the vicinity of the scored fold line 26 to a fold down position, against the resilient force of the tie members, to lie flat against the rear surface 11 of the image board 10 , and while holding them in such depressed fold down position, fold the lower middle portion 22 and upper middle portion 23 towards each other along the scored fold lines 26 and 29 as shown by the arrows 77, 77A, 78 and 79 in FIG. 5. The upper portion 24 may then fold towards the upper middle portion 23 along the scored fold lines 27 and 30 as shown by the arrows 80 and 81, and similarly the lower portion 21 may be folded towards the lower middle portion 22 along the scored fold lines 25 and 28 as shown by arrows 82 and 83. The entire composite display device may thus be folded into a compact collapsed condition having an acceptable size for shipping through regular postal or delivery services. The composite display device in the collapsed condition is self erectable by merely holding the top edge of the image board 10 and raising it upwards; the elasticity of the tie members would automatically pull the side panels and the cross braces to flip to the position perpendicular to the rear surface of the image board to place the easel in the erected condition.

Due to the unique construction, the easel of the present invention may be made with any planar board or sheet material and yet it provides a strong support for the image board.

An alternative manually operative embodiment of the present invention is shown in FIGS. 6 through 9. In this embodiment, the cross braces 84, 85 and 86 are longer than the width of the center body portion 31 of the easel. Thus, when the cross braces 84, 85 and 86 are flipped to the erected position, openings 87 having a quarter circular shaped are formed in the side panels 19 and 20. Two opened slots 88 and 89 are formed in the free outer edge 90 of the cross braces. The opened slots 88 and 89 are in alignment with scored lines 17 and 18 respectively. These opened slots 88 and 89 will engage with the inner edge of the quarter circular shaped opening 87 of the vertical panels 19 and 20 to retain the cross braces and the vertical side panels 19 and 20 in the erected position. The easel may be easily collapsed by flipping the cross braces back to the flat fold down position flat against the rear surface of the image board, and the entire composite easel and image board display device may be folded along the horizontal scored fold lines in the same manner as above.

While the preferred embodiments of the invention have been described above. It will be recognized and understood that various modifications may be made therein and the appended claims are intended to cover all such modifications which may fall within the spirit and scope of the invention.

What is claimed is:

1. In a planar board and easel composite display having said easel attached to a rear surface of said image board and operative to support said image board in an upstanding manner on a floor, said easel comprising, a planar board having a design pattern of an easel formed therein, said design pattern having component parts unfoldable to form said easel in an erected condition, said component parts including two elongated substantially rectangular side panels extending the entire longitudinal length of said planar board, a middle body portion extending between said side panels, said middle body portion being attached to said rear surface of said image board, two parallel vertical scored lines located between said middle body portion and said side panels, and said side panels being unfoldable along said vertical scored lines to form a right side panel and left side panel positioned substantially perpendicular to said image board, a plurality of horizontal brace members formed in said middle body portion and located between said side panels, each brace member being unfoldable along a transverse scored line to a substantially horizontal position extending between said side panels, said brace members being cooperative with said side panels to maintain said easel in an erected condition, a plurality of transverse fold lines formed in said planar board and located between said brace members whereby said composite display device is foldable at said transverse fold lines to a compact collapsed condition, said right side panel and left side panel having a substantially triangular bottom portion having a bottom edge therein sloping slightly upwardly and outwardly away from said middle body portion, each one of said brace members having a free edge located distal from said transverse scored line, and two mounting openings formed adjacent to said free edge wherein a left mounting opening is located left of a mid point of said free edge and a right mounting opening is located right of said mid point, a plurality of pairs of associated mounting opening is located right of said mid point, a plurality of pairs of associated mounting openings formed in said right side panel and said left side panel and located adjacent to a neighboring brace member wherein an upper associated mounting opening is located above said neighboring brace member and a lower associated mounting opening is located below said neighboring brace member when said neighboring brace member is in the substantially horizontal erected position, a plurality of elongated tie members having a cross bar member mounted at both ends therein, one of said tie members being operative selectively to thread through said upper associated mounting opening in said right side panel, said right mounting opening of a neighboring brace member and said lower associated mounting opening of said right side panel, another one of said tie members being operative selectively to thread through said upper associated mounting opening of said left side panel, said left mounting opening of said neighboring brace member and said lower associated mounting opening of said left side panel, for retaining said side panels and said brace members in the erected position.

2. An easel according to claim 1 wherein said tie members have a predetermined length, and said cross bar members therein being positioned crosswise abutting said associated mounting openings after threading for retaining said side panels and said brace members in the erected position.

3. An easel according to claim 2 wherein said tie members are elastic bands, and said composite device is foldable to said compact collapsed condition against resilient force of said elastic bands, and said composite device is self erecting from said collapsed condition to the erected position by said resilient force of said elastic bands.

4. An easel according to claim 3 including a plurality of elongated horizontal openings formed in said middle portion, said horizontal openings being aligned with said plurality of transverse fold lines.

5. An easel according to claim 3 wherein said easel is made of a sheet material chosen from the group of cardboard, corrugated board, and pliable sheet material.

6. An easel according to claim 1 wherein said brace members are longer in length than the width of said middle portion, and two arcuate openings are formed in said side panels when said brace members are unfolded to a substantially horizontal erected position, two opened slots formed in a free edge of said brace members, said free edge being located distal from said transverse scored line of each of said brace members, said opened slots being operative to engage with an inner edge of said arcuate openings of said side panels for retaining said easel in the erected position.

7. A self erecting display device comprising, a large planar image board foldable in a plurality of horizontal fold lines, a vertical easel having a middle body portion therein attached to a rear surface of said image board, and having two substantially rectangular side panels extending over the entire longitudinal length of two opposite vertical sides of said middle body portion, said side panels being selectively pivotable relative to said middle body portion to a position substantially perpendicular to said rear surface of said image board, said easel having a plurality of associated horizontal fold lines aligned with said horizontal fold lines of said image board, a plurality of cross brace members formed in said middle body portion of said easel and located between said associated fold lines and being operative to position selectively in a collapsed position abutting said rear surface of said image board and in an erected horizontal position substantially perpendicular to said rear surface of said image board, said cross brace members having a free outer edge located distal from said image board when said brace members are in said erected position, a pair of openings formed adjacent to said outer edge of each one of said cross brace members, a plurality of pairs of associated openings formed in said side panels, said associated openings being located adjacent to cross brace members, a plurality of elongated elastic tie members having an abutment bar provided at two ends therein, said tie members being mounted between said side panels and said cross brace members by threading through said openings and associated openings whereby said abutment bars are positioned crosswise to said associated openings to retain said tie members in a mounted position, said display device being self erecting to an erected position by a resilient force of said elastic tie members, and being selectively foldable along said fold lines and associated fold lines against said resilient force to a collapsed condition.

8. A self erecting display device according to claim 7 including a triangular portion formed at a bottom portion of said side panels, each one of said side panels having a sloping bottom edge sloping upwardly and outwardly relative to said rear surface of said image board.

9. A self erecting display device according to claim 8 wherein said bottom edge slopes at substantially 5 degrees relative to the horizontal plane.

10. A self erecting display device according to claim 9 wherein three horizontal fold lines are formed in said image board and three aligned associated fold lines are formed in said easel.

11. A self erecting display device according to claim 10 including elongated slot openings formed in said middle body portion at said associated fold lines.

12. A self erecting display device according to claim 11 wherein said easel is made of a cardboard material.

* * * * *